United States Patent [19]

Bentz et al.

[11] 4,211,269

[45] Jul. 8, 1980

[54] METHOD OF CENTRIFUGALLY CASTING METAL UNDER AN INERT ATMOSPHERE

[75] Inventors: Gérard Bentz, Elancourt-Trappes; Jean Galey, Voisins-Bretonneux; Serge Devalois, Fourqueux, all of France

[73] Assignee: L'Air Liquide, Societe Anonyme pour l'Etude et L'Expoitation des Procedes Georges Claude, Paris, France

[21] Appl. No.: 906,553

[22] Filed: May 16, 1978

[30] Foreign Application Priority Data

Jun. 1, 1977 [FR] France ..... 77 16675

[51] Int. Cl.[2] ..... B22D 13/02; B22D 21/02; B22D 23/00

[52] U.S. Cl. ..... 164/67; 164/94; 164/95; 164/114; 164/259; 164/286

[58] Field of Search ..... 164/66, 67, 114, 94, 164/95, 259, 286

[56] References Cited

U.S. PATENT DOCUMENTS

| | | | |
|---|---|---|---|
| 2,710,997 | 6/1955 | Krepps | 164/67 |
| 3,279,006 | 10/1966 | Schwartz et al. | 164/66 X |
| 3,776,295 | 12/1973 | Mola et al. | 164/66 |
| 3,868,987 | 3/1975 | Galey et al. | 164/66 X |

FOREIGN PATENT DOCUMENTS

| | | | |
|---|---|---|---|
| 1304956 | 8/1962 | France | 164/66 |
| 2118867 | 8/1972 | France | 164/66 |
| 2149294 | 3/1973 | France | 164/66 |
| 2150723 | 4/1973 | France | 164/66 |
| 2180494 | 11/1973 | France | 164/66 |

*Primary Examiner*—Robert D. Baldwin
*Assistant Examiner*—Gus T. Hampilos
*Attorney, Agent, or Firm*—Lee C. Robinson, Jr.

[57] ABSTRACT

This invention relates to a method of casting metal in a rotary mould or die under the protection of an inertizing atmosphere formed by a liquefied gas. In the mould or die, successive casting operations are performed with different metals while maintaining an infeed of liquefied gas during each of these casting operations and while the metal involved is solidifying, until an end product is obtained which is formed from a plurality of layers of different metals. The invention is applicable in particular, but not exclusively, to the production of centrifugally cast tubes and rolling-mill rolls.

4 Claims, 3 Drawing Figures

METHOD OF CENTRIFUGALLY CASTING METAL UNDER AN INERT ATMOSPHERE

BACKGROUND OF THE INVENTION

The present invention relates to methods of casting metal in a rotary mould or die, of the kind in which protection is provided simultaneously for the surface of the bath of metal and the space within the mould, prior to casting, by means of a controlled stream of liquefied inert gas which on the one hand is directed over the surface of the bath and which on the other hand is fed into the interior of the mould as it is driven in rotation. Hereinafter, such a method will be referred to as "of the kind described".

This method is applicable to the manufacture of centrifugally cast tubes. Before the metal is introduced into the mould or die, there is first introduced into it a sufficient quantity of liquefied inert gas to give an inert period which will allow the time required to perform the casting proper. With this manufacturing technique, which presupposes that metal is cast only once, the liquefied gas is only introduced prior to the casting.

It is an object of the invention to enable parts formed from a plurality of metals, which thus require a plurality of successive casting operations in the rotary die, to be manufactured.

There are many metal parts which being bodies of revolution, are produced by moulding in a rotary mould or die and which, to withstand the conditions under which they are forced to operate, need to exhibit certain properties to a vary pronounced degree. Thus, ducts intended for conveying corrosive liquids and pipes intended to be submerged in the sea need to exhibit a high resistance to corrosion, whereas rolls for rolling mills need to have circumferential surfaces of extreme hardness. However, metals or alloys which have the requisite qualities are extremely costly and this results in their being used to form only a part of the final article to be obtained, the remainder of the said article being formed from an ordinary, less costly metal. In the case of a duct intended to convey a corrosive liquid for example, only the inside wall which is in direct contact with the said liquids needs to exhibit high resistance to corrosion, to a depth which may be small, and the remainder of the wall, which simply provides mechanical strength, may be formed from ordinary cast iron or steel. Similarly, in the case of a rolling-mill roll only the body, that is to say the outer working surface, needs to be extremely hard, while there is no need for the core of the roll to be of extreme hardness and indeed it is preferable for it to exhibit other characteristics, such as a certain amount of resilience, which leads to its being produced from a relatively malleable and inexpensive material such as grey cast iron.

To produce such articles it is necessary to cast a plurality of metals, generally two, of different kinds in succession in the rotary mould or die, and thus to perform the moulding in a plurality of stages. The first casting operation allows a first layer to be obtained and a second casting operation, which is performed after the time required for the first layer to solidify, allows a second layer to be obtained, and so on.

This procedure has many drawbacks. The mould or die, which is driven in rotation and which is normally preheated, forms a hot, open enclosure which sucks in the surrounding air vigorously. The result is that the casting and solidification of the layers of metal take place in an enclosure through which a stream of very hot and turbulent air flows. When a layer has solidified under these conditions it becomes oxidised on its inner face and this prevents the layer of metal added by the next casting operation from adhering properly. The bond between the two layers is seriously defective and this detracts from the quality of the finished article.

It is therefore a further object of the invention to overcome or minimise these disadvantages and to enable this object to be achieved.

SUMMARY OF THE INVENTION

Accordingly, in a method of the kind described the invention proposes the following steps:

(a) a first casting operation is prepared with a first metal which is applied, by centrifuging, against the wall of the mould or die and which solidifies to form a first outer layer of said first metal, inert liquefied gas continuing to be introduced into the mould or die during this first casting operation and during the solidification, the gas thus filling the cavity inside said first layer, and then, after said first layer has solidified, (b) a second casting operation is performed with a second metal which is applied, by centrifuging, against the inside wall of said first layer so as to fill at least part of said cavity inside said first layer and so as to form a second layer internal to the first layer, the infeed of liquefied gas continuing during said second casting operation and if desired while the metal is solidifying, the gas filling the cavity inside the said second layer at least until it has solidified, and so on until a body-of-revolution end product is obtained which is formed from two or more successive layers of different metals.

The protection from the corrosive action of the air which is obtained in this way during the casting and solidification phase enables solidified layers of metal to be obtained which are completely free from surface oxidation, thus enabling an excellent bond between two successive layers to be obtained.

In accordance with another feature of the invention, a plurality of layers is formed while leaving a hollow space inside the final layer, thus producing a tubular end product, the liquefied gas filling the hollow space in the course of the solidification of the last layer.

In this way ducts or pipes can be obtained in which the outer part of the final layer, which is cast last, that is to say on the inside of the finished pipe or duct, is free from any oxidation.

In accordance with another feature of the invention, a plurality of casting operations is performed, the final casting operation filling up the whole of the space enclosed by the layer formed by the casting operation which preceded it, thus producing a solid end product.

This method of casting is used to produce rolling-mill rolls.

The liquefied gas may be introduced into the mould or die during the successive casting operations and in the course of the solidification phase, in a quantity per minute which corresponds to a volume of gas in the gaseous phase equal to five or ten times the volume of the cavity to be filled, thus maintaining in the cavity an atmosphere having an oxygen content of less than 0.1%.

Such an oxygen content enables oxidation to be avoided or minimised.

BRIEF DESCRIPTION OF THE DRAWINGS

Other advantages and features of the invention will become apparent from a purusal of the following description, taken in conjunction with the accompanying drawings, which are given solely by way of example, and in which.

DETAILED DESCRIPTION OF PREFERRED EMBODIMENTS

The production of body-of-revolution articles formed from a plurality of metals or alloys has to be performed in a plurality of stages in rotary moulds or dies which may have either horizontal or vertical axes, the first being used chiefly for producing hollow articles, the second for producing solid articles.

Figure 1:
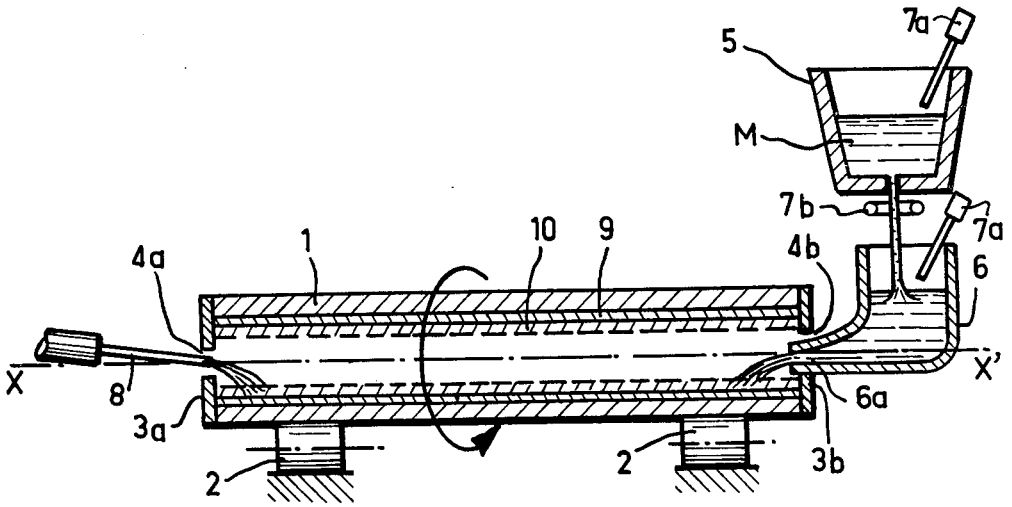
FIG. 1 is a schematic view of the production, by centrifuging, of a tube.

Referring now to the drawings, the mould or die 1 in FIG. 1 is a steel die of tubular shape having a horizontal axis. It is supported by two rollers 2 which drive it in rotation about its axis XX' and its two ends are closed off by two end-pieces *3a*, *3b* which are provided with respective openings *4a*, *4b*. The molten metal M, which is contained in a ladle 5, flows out into a pouring basin 6 and pours into the interior of the mould or die 1 through a spout *6a* which passes through the opening *4b* in end-piece *3b*. The metal in the ladle 5 and in the basin 6, and also the stream of metal dropping into the basin are protected by the continuous application of an inertising liquefied gas by means of devices of a known type such as nozzles *7a* and a ring *7b*. The liquefied gas exemplified as nitrogen, is introduced into the interior of the mould 1 by a nozzle 8 which passes through the opening *4a* in end-piece *3a*.

The aim is to use this mould or die to produce a tube formed from two layers of metals of different kind (a bimetallic tube). The tube has a length of approximately 4 meters, an outside diameter of 30 cm, an inside diameter of 25 cm and thus a thickness of 2.5 cm.

The casting takes place as follows:

The die, which is driven in rotation by any suitable means well-known in the art, but not illustrated, is first purged and inertised. The liquefied nitrogen, which is poured in at a constant rate of two liters per minute for three minutes, quickly fills the die and, by virtue of the rotation, spreads uniformly over the entire length of its inside wall. As soon as the liquefied gas enters, the air contained in the die is forcibly expelled since the gaseous expansion as a result of evaporation is very great, one liter of liquid nitrogen at 15° C. producing approximately 680 liters of gas. In this way a nitrogen atmosphere containing less than 0.1% oxygen is obtained within the mould.

A first metal or alloy, such as nickel-chrome, is then cast, to produce an outer layer 9 approximately 5 mm thick. During the casting of this first metal, which lasts approximately one minute, liquid nitrogen continues to be poured in at the abovementioned rate.

There is then a wait of approximately three minutes until the first layer 9 has solidified, the infeed of nitrogen remaining constant during the solidification.

A second metal or alloy different from the first, such as cast iron for example, is then cast to produce a second layer 10 approximately 20 mm thick. During the second casting operation, which lasts approximately one minute, liquid nitrogen continues to be fed in at the above mentioned rate. The die is allowed to rotate and the infeed of liquid nitrogen is continued for approximately one minute to ensure that the second layer 10 has solidified sufficiently.

The rotation of the die is then slowed down and the finished tube is extracted.

The total length of the operation is approximately nine minutes and the quantity of liquified nitrogen is approximately eighteen liters.

The final tube obtained thus has a thin outer layer 9 having for example high resistance to corrosion, and an inner layer 10 which is much thicker and which is made for example from a far less expensive metal than the outer layer.

The fact of first having purged the die and then having maintained an oxygen-free atmosphere during the casting of the first metal and during its solidification and also during the casting of the second metal until it has solidified makes it possible to prevent any pollution of the inner face of the first layer and thus ensures an excellent bond between the first layer and the second layer. The absence of pollution is due not only to the absence of oxygen but also to the absence of water vapour, which is always present in atmospheric air.

The mould or die 12 in FIG. 12 is a steel die of cylindrical shape having a vertical axis, whose diameter is approximately 0.35 meters and whose height is approximately 0.70 meters. At the bottom, the mould or die 12 continues into a mould or die 13, which is also of cylindrical shape but of substantially smaller dimensions, the second die having a diameter of approximately 0.15 meters and a height of approximately 0.20 meters. The assembly formed by the dies 12 and 13 is driven in rotation about its vertical axis YY' at approximately 800 rpm by any convenient means which are not shown, but which are well-known in the art. At the top, the die 12 is closed off by a cover 14. The cover 14 is provided with an opening 15 through which passes a casting spout 16 which is connected to a pouring basin (not shown) and which is surrounded by a jacket 17. The inert liquefied gas is fed in through a heat-insulated nozzle 18 which is connected to a source (not shown). The liquefied gas thus enters the die through the opening 15 parallel to the flow of metal entering through the spout 6.

In this die, the aim is to produce a roll for a rolling-mill formed by an outer layer of high mechanical strength and an inner core made from a less strong but more malleable metal.

The sequence of operations is closely comparable with that employed in the production of the centrifugally cast tube.

The mould or die, which is driven in rotation, is first of all purged and inertised by feeding into it liquefied gas, which is nitrogen in this case, at a rate of two liters per minute for approximately 1½ minutes.

The first metal, such as nickel cast iron, is then cast to produce a first outer layer 19, or body, having a thickness of approximately 1 cm. During this casting operation, which lasts approximately thirty seconds, the die continues to be fed with liquid nitrogen.

While the die continues to be fed with liquid nitrogen, there is a wait of approximately six minutes for the body to solidify.

A second metal, such as grey cast iron, is then cast and this metal fills the interior of the die 12 to produce a core 20, and the interior of the die 13 to produce a journal 21. During the casting of this second metal, which lasts approximately one minute, the liquefied nitrogen continues to be supplied until the end of the casting operation.

The mould is then slowed down and stopped and the roll extracted.

The total length of the operation is approximately nine minutes and the consumption of liquefied nitrogen is approximately eighteen liters.

In this way there is obtained a rolling-mill roll having a weight of approximately 500 kg. and a diameter of approximately 0.35 meters. The roll is formed by an outer body of extreme hardness and high abrasion resistance, and an inner core which is of greater resilience and has a greater capacity for flexing.

As in the previous case, the interface between the two layers is substantially free of any pollution or oxidisation and there is thus excellent cohesion between the two layers.

Examination of articles produced by this method shows that the adhesion between the two layers remains excellent even after crushing tests.

Figure 3:
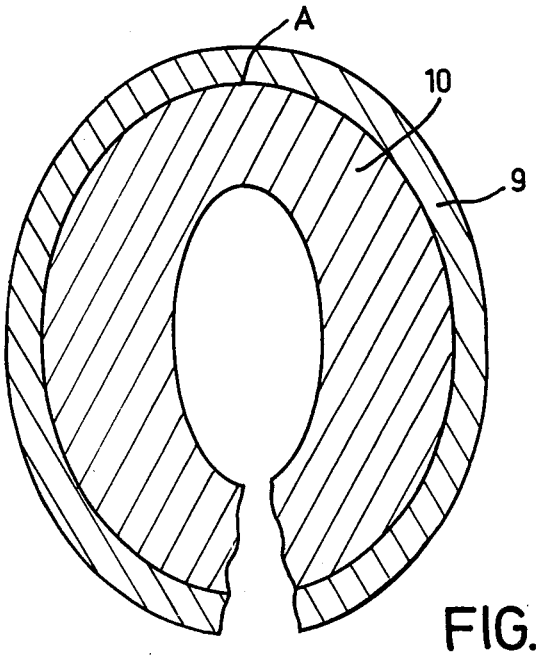
FIG. 3 is a cross-section view of a tube made up of two successive layers which has undergone a crushing test.
Figure 2:
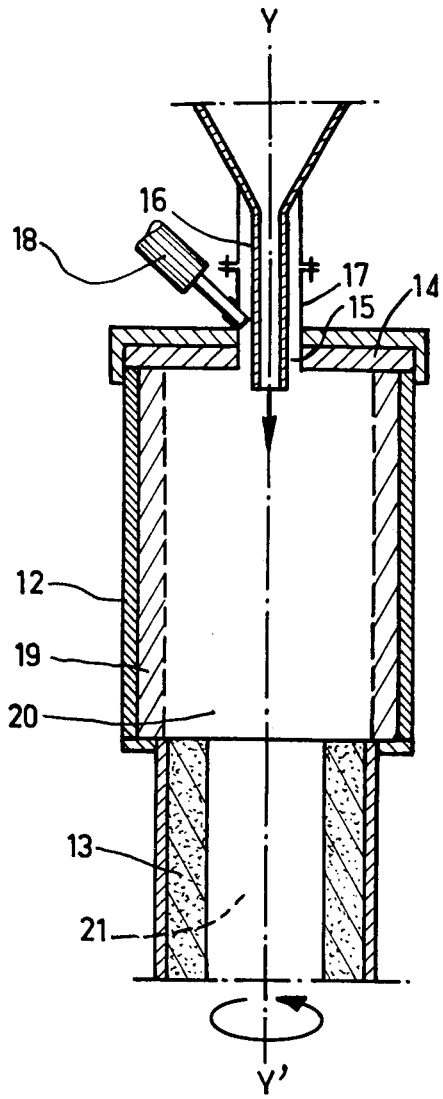
FIG. 2 shows the production of a rolling-mill roll.

FIG. 3 is a cross-sectional view of a tube obtained by the moulding method illustrated in FIG. 1 and shows that when such a tube is crushed after having been split longitudinally there is no tendency for the layers 9 and 10 to separate even in the region A of maximum deformation.

It would of course be possible to make many modifications to the two methods described and illustrated above. Thus, it would be possible to have articles which, instead of two layers, were formed from three layers or more. In this case the die would be supplied with liquefied gas during the casting of each layer and during its solidification. The liquefied gas could be formed by any gas other than nitrogen, such as argon.

The method is equally applicable to all plain metals or metallic compounds or alloys. Examples of suitable plain metals are iron, copper and chromium. Examples of suitable metallic compounds are cast iron and steel. Examples of suitable alloys are nickel-chrome and nickel-cast iron. Other plain metals, metallic compounds and alloys may of course be employed as will now be apparent to these skilled in the art to which this invention relates.

The thickness of the layers may also be as desired, the thickness depending solely on the properties demanded from the article finally obtained.

We claim:

1. In a method of casting metal in a rotary mold, the steps of:

continuously rotating the mold;

introducing inert liquified gas into the rotating mold to spread the liquid over the inner surface of said mold;

directing a first molten metal into the rotating mold, the first metal being urged by centrifuging against the inner surface of the mold and solidifying therein to form a first metallic layer;

continuing the introduction of inert liquified gas into the rotating mold as the first molten metal is directed thereto and during the solidification of the first metal, the gas filling the cavity formed by said first metallic layer;

said inert liquified gas being introduced into said mold during the insertion of said first molten metal at a rate corresponding to a volume of gas in the gaseous phase equal to at least five times the volume of the cavity to be filled, to maintain in the cavity an atmosphere having an oxygen content of less than 0.1%; and directing a second molten metal into the rotating mold after the solidification of the first metal, the second metal being urged by centrifuging against the inner surface of the cavity formed by said first layer and solidifying therein to form a second metallic layer.

2. In a method of casting metal in a rotary mold, the steps of:

continuously rotating the mold;

introducing inert liquified gas into the rotating mold to spread the liquid over the inner surface of the mold;

directing a first molten metal into the rotating mold, the first metal being urged by centrifuging against the inner surface of the mold and solidifying therein to form a first metallic layer;

continuing the introduction of inert liquified gas into the rotating mold as the first molten metal is directed thereto and during the solidification of the first metal, the gas filling the cavity formed by said first metallic layer;

directing a second molten metal into the rotating mold after the solidification of the first metal, the second metal being urged by centrifuging against the inner surface of the cavity formed by said first layer and solidifying therein to form a second metallic layer; and continuing the introduction of inert liquified gas into the rotating mold as the second molten metal is directed thereto;

said inert liquified gas being introduced into said mold during the insertion of at least one of said molten metals therein at a rate corresponding to a volume of gas in the gaseous phase equal to at least five times the volume of the cavity to be filled, to maintain in the cavity an atmosphere having an oxygen content of less than 0.1%.

3. In a method of casting metal in a rotary mold, the steps of:

continuously rotating the mold at a constant speed;

introducing inert liquified gas into the rotating mold to spread the liquid over the inner surface of said mold;

directing a first molten metal into the rotating mold, the first metal being urged by centrifuging against the inner surface of the mold and solidifying therein to form a first metallic layer;

continuing the introduction of inert liquified gas into the rotating mold as the first molten metal is directed thereto and during the solidification of the first metal, the gas filling the cavity formed by said first metallic layer;

directing a second molten metal into the rotating mold after the solidification of the first metal, the second metal being urged by centrifuging against the inner surface of the cavity formed by said first layer and solidifying therein to form a second metallic layer; and continuing the introduction of inert liquified gas into the rotating mold as the second molten metal is directed thereto and during the solidification of the second metal;

said inert liquified gas being introduced into said mold during the insertion of at least one of said molten metals therein at a rate corresponding to a volume of gas in the gaseous phase equal to at least five times the volume of the cavity to be filled, to maintain in the cavity an atmosphere having an oxygen content of less than 0.1%.

4. In a method of casting metal in a rotary mould or die, in which protection is provided simultaneously for the surface of the bath of metal and for the space within said mould or die, prior to casting, by means of a controlled stream of inert liquified gas which on the one hand is directed over the surface of the bath and on the other hand into the interior of said mould or die, which is driven in rotation, the invention which comprises the following steps:

(a) a first casting operation is performed with a first metal which is applied, by centrifuging, against the wall of said mould or die and which solidifies to form a first outer layer of said first metal, said inert liquified gas continuing to be introduced into said mould or die during this first casting operation and during the solidification, the gas thus filling the cavity inside said first layer, and then, after said first layer has solidified, (b) a second casting operation is performed with a second metal which is applied, by centrifuging, against the inner wall of said first layer so as to fill at least part of the space inside said first layer and so as to form a second layer internal to said first layer, the infeed of said liquified gas continuing during said second casting operation, said gas thus filling the cavity inside said second layer at least until it has solidified, (c) said steps are repeatedly carried out until a body-of-revolution end product is obtained which is formed from at least two successive layers of different metals, and (d) said liquified gas being introduced into said mould or die during the successive casting operations and in the course of the solidification phase in a quantity per minute which corresponds to a volume of gas in the gaseous phase equal to five to ten times the volume of the cavity to be filled, to maintain in the cavity an atmosphere having an oxygen content of less than 0.1%.

* * * * *